US006761287B2

(12) United States Patent
Caruso

(10) Patent No.: US 6,761,287 B2
(45) Date of Patent: Jul. 13, 2004

(54) PAINT CAN LID WITH EASY ACCESS FOR ADDING AND VIEWING TINT

(76) Inventor: Nicholas A. Caruso, 2 Lester Ct., New Castle, DE (US) 19720

( * ) Notice: Subject to any disclaimer, the term of this patent is extended or adjusted under 35 U.S.C. 154(b) by 0 days.

(21) Appl. No.: 10/252,656

(22) Filed: Sep. 23, 2002

(65) Prior Publication Data

US 2004/0055259 A1 Mar. 25, 2004

(51) Int. Cl.[7] ..... B67D 5/38

(52) U.S. Cl. ..... 222/154; 222/562; 220/284; 220/377; 215/302

(58) Field of Search ..... 222/154, 562; 220/284, 286, 377; 215/302, 315

(56) References Cited

U.S. PATENT DOCUMENTS

| | | | | |
|---|---|---|---|---|
| 2,040,088 A | | 5/1936 | Jesevich | |
| 3,672,547 A | * | 6/1972 | Kozlowski | 222/567 |
| 4,069,935 A | * | 1/1978 | Hampel | 215/203 |
| 4,793,504 A | * | 12/1988 | Towns et al. | 215/250 |
| 5,137,188 A | | 8/1992 | Thompson | 222/570 |
| 5,152,417 A | | 10/1992 | Gallagher | 220/355 |
| 5,305,909 A | | 4/1994 | Merritt | 220/579 |
| 5,316,169 A | | 5/1994 | Gallagher | 220/355 |
| 5,388,715 A | | 2/1995 | Schwindt | 220/354 |
| 5,404,611 A | | 4/1995 | Raney | 15/257.06 |
| 5,437,400 A | | 8/1995 | Loeffler | 222/570 |
| 5,533,802 A | | 7/1996 | Garganese | 366/256 |
| 5,566,391 A | | 10/1996 | Williamson | 2/51 |
| 5,626,258 A | | 5/1997 | Maiorino | 220/695 |
| 5,669,526 A | | 9/1997 | Keyfauver | 220/696 |
| 5,695,098 A | | 12/1997 | King | 224/148.7 |
| 6,102,235 A | | 8/2000 | Stern et al. | 220/212 |
| 6,250,494 B1 | | 6/2001 | Clementi | 220/783 |
| 6,354,063 B1 | | 3/2002 | Golownia | 53/431 |
| 6,401,952 B1 | * | 6/2002 | Ming | 220/4.09 |
| 2002/0063134 A1 | | 5/2002 | Von Holdt, Sr. et al. | 220/657 |

FOREIGN PATENT DOCUMENTS

| | | |
|---|---|---|
| WO | WO 92/13778 | 8/1992 |

OTHER PUBLICATIONS

"Everything but the brush!," PACKAGINGWORLD® (www.packworld.com), Jul. 2002.

* cited by examiner

*Primary Examiner*—Philippe Derakshani
(74) *Attorney, Agent, or Firm*—RatnerPrestia

(57) ABSTRACT

A port assembly for a paint or similar can, in which a port in the lid is fitted with a threaded collar and a threaded stopper that fits into it. The port assembly allows easy access to the contents of the can while maintaining a good seal around the rim. If the threaded stopper is transparent and colorless, a user may view the contents of the can.

16 Claims, 4 Drawing Sheets

PAINT CAN LID WITH EASY ACCESS FOR ADDING AND VIEWING TINT

FIELD OF THE INVENTION

This invention relates to paint can lids. More particularly, it relates to a removable port assembly allowing easy access to the contents of the can while maintaining a good seal around the rim.

BACKGROUND OF THE INVENTION

Paint is commonly tinted by opening the metal lid of a can containing a coating base, which may already have some tint in it, and adding concentrated colorant to match a color specified by a customer. One problem with this system is that the lids on cans do not close properly, in many instances. A paint spill may therefore occur when the container is subsequently agitated, typically by shaking, due to the force of the liquid pushing against the lid. If a tint/stain system is used, wherein the colorant is added to a low-viscosity coating base for applications such as for example stains for wooden decks, the problem is more pronounced, particularly since paint cans and lids are not manufactured to tight tolerances, thus allowing the potential for leakage.

Additionally, the above-mentioned procedure requires that the paint can then be opened so that the customer can check the color of the paint for accuracy, usually by painting a swatch on top of the lid, and may require a further addition of concentrated colorant and resealing, followed by additional shaking of the can. All of this is time-consuming and potentially messy.

Beyond these issues, paint cans are then opened by the user once the painting task begins, with the paint being typically poured out of the can, during which the paint tends to run into the gutter in the rim of the can. The result is that dried paint builds up in this location, preventing proper sealing of the can thereafter. Due to this, air gets into the can, causing deterioration of the paint in storage, and the presence of paint in the gutter may also cause rusting, which may contaminate the paint. As well, depending on the toxicity of the materials present in the can, issues of environmental exposure may be created by the poor seal, including the risk of accidental opening of the can during the disposal process.

Although the discussion herein concentrates on the structure of paint cans, it will be appreciated that a number of materials can be stored in such cans, with some of the same problems noted above. Therefore use of the term "paint can" herein means the kind of can traditionally known for storing paint, but not limited to any particular contents of the can, as it is known in the art that such cans may contain paint, stain, varnish, etc.

There continues to be a need for improved ways of accessing the contents of paint cans for viewing and/or dispensing, while maintaining a good seal around the rim of the lid.

SUMMARY OF THE INVENTION

In one aspect, the invention is a port assembly for a can with a removable lid, the port assembly allowing inspection of and access to the interior of the can without removal of the lid. The port assembly comprises a port in the lid and a port stopper adapted to close the port in the lid to prevent contents of the can from escaping. When opened, the port assembly provides access to the contents of the can. The port stopper has at least one portion that is substantially transparent and substantially colorless, allowing visual inspection of the contents of the can when the port assembly is closed.

In another aspect, the invention is a pouring spout adapted to interface with a port assembly in a removable lid of a can, the port assembly comprising a port in the lid; and a port stopper adapted to interface with the port to create a closed configuration in which contents of the can cannot escape and an open configuration that provides access to the contents of the can, the pouring spout having means for interfacing with the port.

In yet another aspect, the invention is a removable lid for a can, the lid comprising a port assembly for allowing inspection of and access to the interior of the can without removal of the lid, as described above.

In a further aspect, the invention comprises a can including a lid and a port assembly in the lid, as described above.

In a still further aspect, the invention is a method of adding a material to a can. The can has a removable lid with a port that is adapted to interface with a port stopper to create a closed configuration in which contents of the can cannot escape, and an open configuration that provides access to contents of the can. The port stopper has at least one portion that is substantially transparent and substantially colorless, to allow visual inspection of the contents of the can in the closed configuration. The method comprises introducing the material into the can through the port without removing the lid; and engaging the port with the port stopper.

DETAILED DESCRIPTION OF THE INVENTION

The invention will next be illustrated with reference to the figures, wherein the same numbers indicate the same elements in all figures. Such figures are intended to be illustrative rather than limiting and are included herewith to facilitate the explanation of the present invention. The figures are not to scale, and not intended as engineering drawings.

Figure 1:
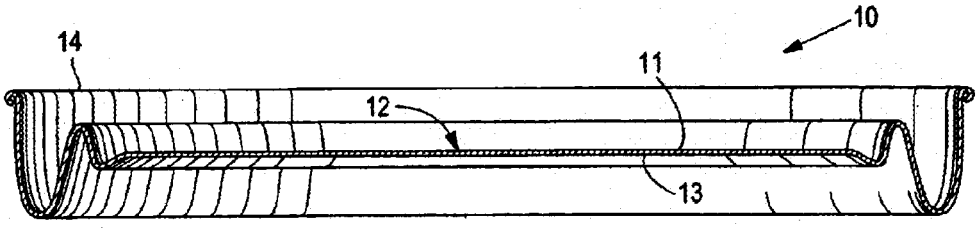
FIG. 1 PRIOR ART
FIG. 1 is a side cross-sectional view of a prior art paint can lid.

Referring now to FIG. 1, there is shown a side cross-sectional view of a prior art lid 10 comprising a main lid body 12 and a raised rim 14. The main lid body has an upper surface 11 and a lower surface 13, which is inside a can when the lid is in use. Such a lid is commonly used in sealing cans such as might be used for paints, varnishes, stains, laquers, and a variety of other liquid or solid materials. The lid may be made of a metal, typically steel, but may be made of any of a number of materials including other metals and a variety of plastics. The rim 14 of the lid is pressed into a receiving V-shaped notch in the open top of a can (not shown), thereby sealing the can.

Figure 2:
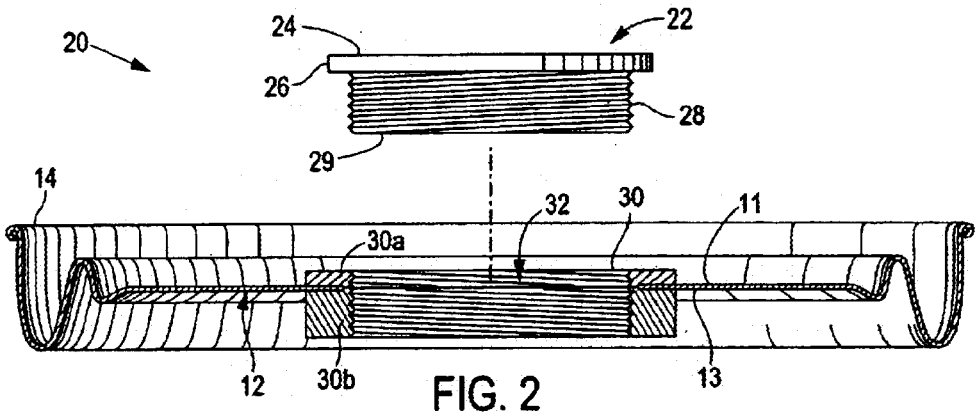
FIG. 2 is an exploded side view of a paint can lid equipped with a port assembly comprising a port stopper and a port collar, according to one aspect of the invention.

FIG. 2 shows, according to one embodiment of the invention, a lid 20 equipped with a port assembly, useful for accessing the interior of a can on which the lid is mounted, without a need to remove the lid. The figure shows the port assembly comprising a port stopper 22 (shown in side view) in position to be screwed into a port collar 30 (shown in side cross-section view), to close port 32 in the main lid body 12. Materials of construction for the main lid body 12 and rim 14 may be any convenient material known in the art, and may as nonlimiting examples comprise a metal, glass, or a polymeric material. Typically the lid will comprise steel for the main lid body and the rim.

Port stopper 22 has a top 24 comprising an optional lip 26, and top 24 is integral with first threaded cylinder 28, which has a bottom 29. Optional lip 26 extends beyond the diameter of first threaded cylinder 28, and may serve to reduce contamination of the contents of the can to which the lid is attached. Although first threaded cylinder 28 is shown as threaded along most of its length, it need only be threaded on the end section adjacent bottom 29. In addition, although the threads are shown in FIG. 2 as straight, they may have a taper. The threads may be of any convenient pitch and threads/unit length.

Materials of construction for port stopper 22 may be any convenient material including, as nonlimiting examples, a metal, wood, glass, ceramic, or a polymeric material. Preferred is a substantially transparent and substantially colorless material, with nonlimiting examples being polymethyl methacrylate, polycarbonate, and polyethylene terephthalate. In addition, it may be advantageous to use materials of construction for port stopper 22, or coatings thereon, that cause the contents of the can to wet and/or adhere to the surface of the stopper. Conversely, for some applications it may be advantageous for the materials or construction or coatings to resist wetting by the contents of the can.

Port collar 30 comprises a hollow cylinder, threaded on the inside surface, and open at both ends. In the embodiment of FIG. 2, port collar 30 comprises upper and lower collars 30*a* and 30*b*, which are attached to the upper an lower surfaces 11 and 13, respectively, of main lid body 12. The upper and lower collars may be separate as shown, or may be integral with each other, for example by means of connecting portions going through holes in main lid body 12 (holes not shown). In addition, upper collar 30*a* is optional, and may be dispensed with entirely. Port collar 30 may be made from any convenient material known in the art, including as nonlimiting examples a metal, wood, glass, ceramic, or a polymeric material. Most typically, port collar 30 will comprise steel.

Figure 3:
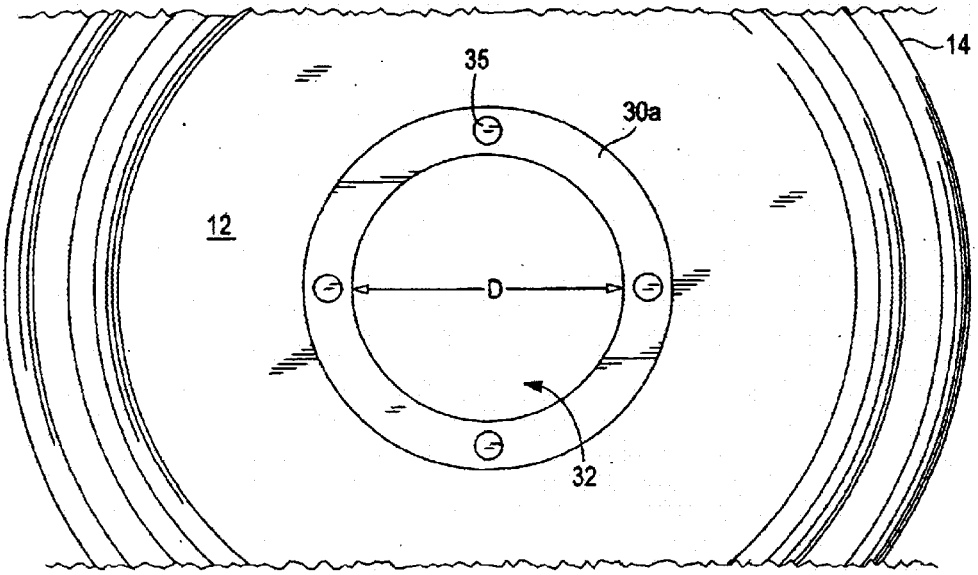
FIG. 3 is a top view of the paint can lid of FIG. 2, showing the port collar in place.

FIG. 3 shows a top view of one embodiment of an upper collar 30*a* such as was seen in FIG. 2. Upper collar 30*a* overlies and is coextensive with an opening in main lid body 12, forming port 32 of diameter D. In this embodiment, upper collar 30*a* is attached to main lid body 12 and lower collar 30*b* (not shown) by means of fasteners 35, such as screws or rivets. Although fasteners are shown screws or rivets. Although fasteners are shown in FIG. 3, adhesives such as epoxy or polyisocyanate resins, or other attachment means may also be used.

Figure 4:
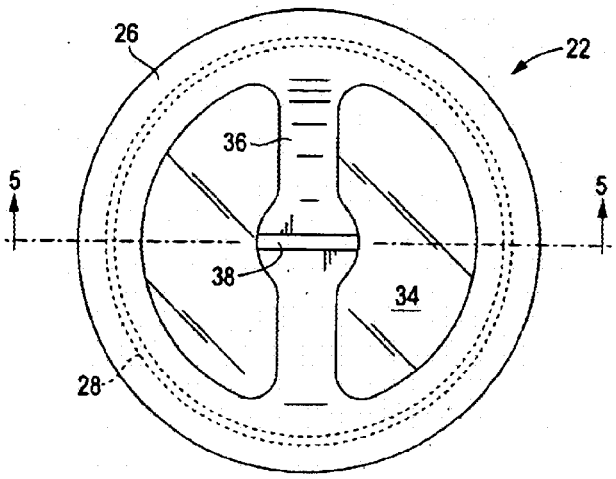
FIG. 4 is a top view of the port stopper of FIG. 2.
Figure 5:
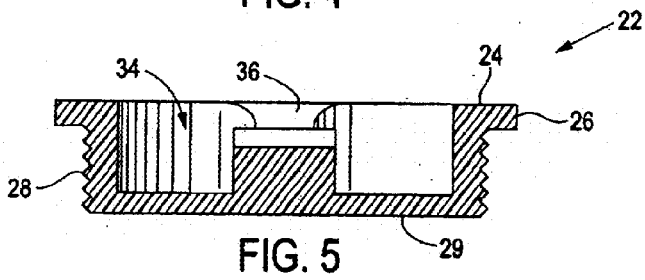
FIG. 5 is a side cross-sectional view of the port stopper of FIG. 2 and FIG. 4.

FIGS. 4 and 5 show, respectively, a top view and a side cross-section view of one embodiment of a port stopper 22 such as was seen in FIG. 2, showing additional detail, according to the invention. FIG. 4 shows a depression 34 in the top of port stopper 22, with the bottom 29 underlying depression 34 being attached to (or integral with) a raised grip 36, suitable for being grasped when opening the port. An optional slot 38 is shown on grip 36, suitable for engaging with a spatulate tool, for example a screwdriver, or coin, or the like in opening the port.

In the embodiment shown in FIG. 4, grip 36 is a straight bar of approximately rectangular cross-section extending across and integral with (or affixed to) bottom 29 within the depression 34, on a diameter thereof. Other shapes are however possible for grip 36, including but not limited to bars with curved sides, multiple bars, bars arranged in a spokelike manner, bars with a non-rectangular cross section, and a plurality of pegs instead of bars. Alternatively, grip 36 may be configured such that port stopper 22 can be removed by a common tool such as a wrench, or configured to match the shape of a custom-made tool. Other configurations of grip 36 may be contemplated, and are intended to be considered within the scope of this invention.

In general, instead of or in addition to grip 36, there may be provided one or more means for engagement of and transfer of torque to the port stopper for unscrewing the port stopper from the port collar. Such means might include, but are not limited to, slots, multiple holes for engagement of special tools, depressions with geometric shapes for engagement by screwdrivers (Phillips head, hex, star head, etc.) or other tools (such as but not limited to a bung wrench), or any geometry suitable for engagement by the human hand.

FIG. 5 shows the port stopper 22 of FIG. 4 in cross-sectional view. In this embodiment of the invention, the top of grip 36 is recessed relative to the top 24 of the port stopper. The top of grip 36 may however be even with top 24, or above it. Preferably however, grip 36 is not so high as to extend above the rim 14 of lid 10 (reference FIG. 2). Such an arrangement is conducive to cans having lids equipped with port assemblies.

In a preferred embodiment of the invention, at least a portion of bottom 29 and/or grip 36 of port stopper 22 is substantially transparent and substantially colorless, allowing the user to see the color of the contents of a can employing a lid 20 equipped with a port assembly according to the invention, without the need to remove the port stopper 22. By substantially transparent and substantially colorless, it is meant that a user can visually inspect the contents of the can through the port stopper without having to remove the stopper, and that the view so obtained is a good representation of what the contents would look like without the stopper in place. Thus, for example, the port may somewhat hazy, as long as sufficient light is transmitted to allow an accurate view of the contents.

Figure 6:
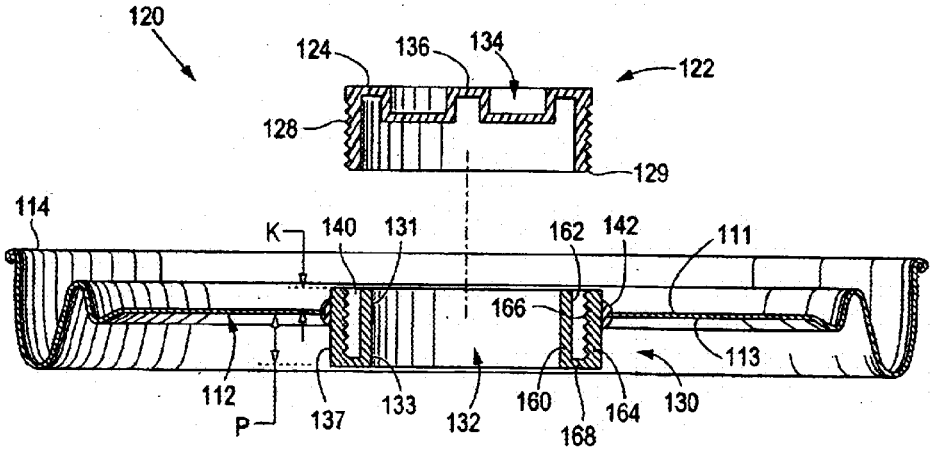
FIG. 6 is an exploded cross-sectional view of a paint can lid equipped with a port assembly comprising a port stopper and matching port collar configured to minimize contamination by paint of threads designed to join the two, according to another aspect of the invention.

FIG. 6 shows another embodiment of the invention, showing in cross-sectional view a lid 120 with a port assembly. The port assembly comprises port stopper 122, shown here in position for screwing into port collar 130, to close port 132 in main lid body 112. Port stopper 122 has a top 124 that is integral with a first threaded cylinder 128, which is open at the bottom end 129. Although first threaded cylinder 128 is shown as threaded along most of its length, it need only be threaded on the end section adjacent bottom end 129. As well, threaded cylinder 128 may be longer than annular space 140 into which it screws, leaving a portion of threaded cylinder 128 protruding from annular space 140. Or, threaded cylinder 128 may be so short in length that, when screwed into annular region 140, it does not reach the bottom. In addition, although the threads are shown in FIG. 6 as straight, they may have a taper. The threads may be of any convenient pitch and threads/unit length.

In the embodiment shown in FIG. 6, grip 136 (seen in an end-view) is a straight bar of approximately rectangular cross-section extending across and within a depression 134 in top 124, on a diameter thereof. Although grip 136 may be a hollow raised structure, as shown in FIG. 6, it may instead be solid. Other shapes are however possible for grip 136, including but not limited to means of engagement such as have been described above in relation to grip 36, in relation to FIGS. 4 and 5. Even further configurations of grip 136 may be contemplated, and are intended to be considered within the scope of this invention.

In a preferred embodiment of the invention, and as discussed above in relation to FIG. 5, at least a portion of top 124, including grip 136 and/or the part of top 124 under depression 134, of port stopper 122 is substantially transparent and substantially colorless.

Port collar 130 comprises a threaded well comprising an inner tube 160 having an outer surface 162, an outer tube 164 having an inner surface 166, a connecting ring 168 between the inner tube and the outer tube, and an annular region 140 between the inner surface of the outer tube and the outer surface of the inner tube, with threads being located on the inner surface 166 of the outer tube 164.

Port collar 130 is affixed on its outer surface 137 to main lid body 112 at joint 142, forming port 132. The top end 131 of port collar 130 may lie flush with the upper surface 111 of main lid body 112, or may extend a distance K above it. Distance K may be between about 0 inch about ⅜ inch, preferably about ⅛ inch. The distance, if any, that joint 142 rises above upper surface 111 of main lid body 112 will depend upon distance K, and will be determined by considerations of convenience and mechanical strength. The bottom end 133 of port collar 130 extends a distance P below the lower surface 113 of main lid body 112. Distance P is typically between about ¼ inch and about 1 inch, preferably about ½ inch. By virtue of the presence of the protrusion of the bottom end 133 below the lower surface 113, there may be additional mixing action created when a can fitted with such a port collar is agitated, thus providing improved homogeneity of the liquid being mixed.

Joint 142 may be provided by for example press-fitting port collar 130 into main lid body 412, by welding or soldering it in place. Alternatively, port collar 130 and main lid body 112 may both be part of a single piece, obtained for example by molding, in which case joint 142 may be automatically incorporated during the preparation of lid 120. As another alternative, port collar 130 and main lid body 112 may be affixed together with a polymeric material. Useful materials include, inter alia, cross-linked polyethylene, poly (ethylene-vinyl acetate), polyvinyl chloride, polystyrene, polyurea, or polyurethane. Preferred are resilient materials such as synthetic and natural latex rubbers, neoprene, acrylonitrile-butadiene-styrene or styrene-butadiene-styrene block copolymers, thermoplastic elastomers, ethylene-propylene rubbers, and silicone elastomers. The exact dimensions of joint 142 are not critical, but may typically be a band about ⅜ inch wide and about ⅛ inch thick. The term "thick" here means in a direction outward from port collar 130 along main body lid 112.

Figure 7:
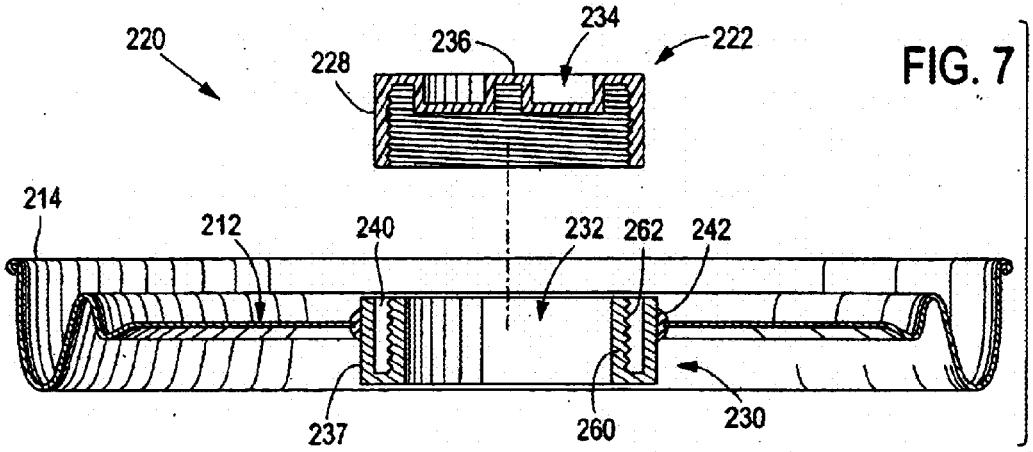
FIG. 7 is an exploded cross-sectional view of a paint can lid similar to that of FIG. 6, with the threads on the port stopper and port collar reversed, according to yet another aspect of the invention.

FIG. 7 shows, as provided by the invention, an embodiment in which the threaded portions of port stopper 228 and port collar 230 are reversed, relative to the configuration shown in FIG. 6. Thus in FIG. 7 the threads in port collar 230 are on the outer surface 262 of inner tube 260, and the threaded portion of port stopper 222 is arranged to match this configuration.

Figure 8:
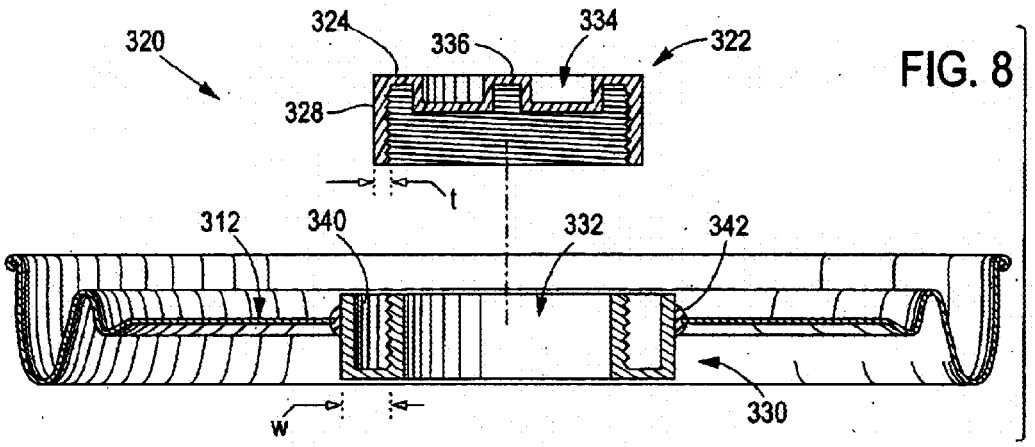
FIG. 8 is an exploded cross-sectional view of a paint can lid similar to that of FIG. 7, showing additional space where the port stopper screws into the port collar, according to still another aspect of the invention.

FIG. 8 shows an embodiment of the invention similar to that of FIG. 7, in which annular region 340 has a width (w) that is wider than the thickness (t) of threaded cylinder 328, thereby affording an empty space (w-t) within annular region 340 even when threaded cylinder 328 is screwed into port collar 330. Such an empty space may facilitate screwing port stopper 322 and port collar 330 together by allowing outflow of air or liquid from annular region 340. An example of liquid that might be present in annular region 340 may for example be paint or varnish or other contents spilled or overflowed from a can to which a lid 320 having a port assembly is attached.

Figure 9:
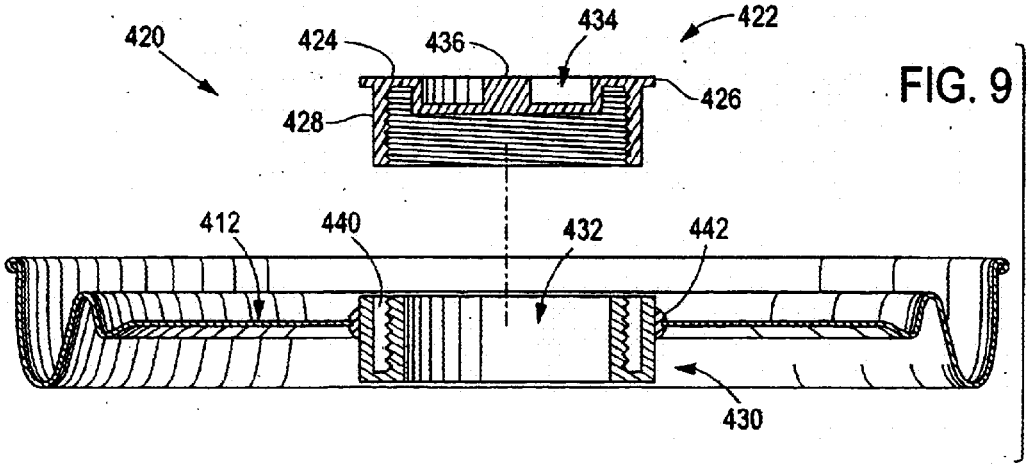
FIG. 9 is an exploded cross-sectional view of a paint can lid similar to that of FIG. 7, showing a lip around the top of the port stopper, according to a further aspect of the invention.

FIG. 9 shows another embodiment of the invention, similar to that shown in FIG. 6, in which top 424 of port stopper 422 additionally comprises a lip 426, which may serve to reduce contamination of annular region 440 by any of a variety of materials that might tend to find their way into it, for example dust and dirt, or spilled can contents. Lip 426 may extend any convenient distance from threaded cylinder 428, and will typically be wide enough to extend at least to cover substantially all of port collar 430 when the port stopper 422 has been screwed into it. Also, as shown in FIG. 9, grip 436 may optionally be solid rather than hollow.

Figure 10:
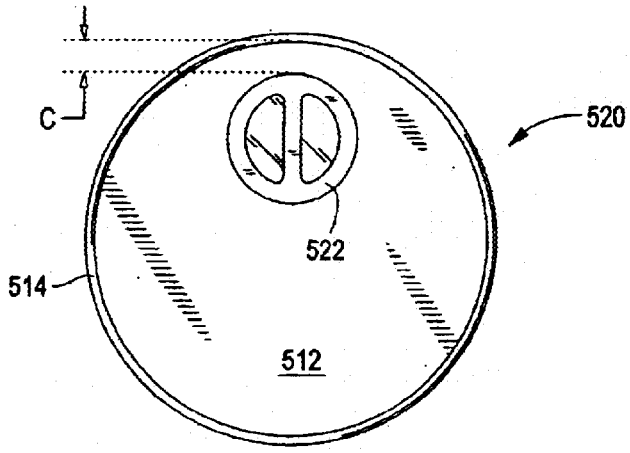
FIG. 10 is a top view of a lid with a port assembly in place, showing positioning of the port assembly relative to the rim, according to a still further aspect of the invention.

FIG. 10 shows yet another exemplary embodiment of a lid 520 according to the invention, comprising a rim 514 and a main lid body 512 fitted with a port assembly consisting of a port stopper 522 and a port collar (hidden from view beneath port stopper 522). The port stopper 522 is located at a distance C from rim 514. Distance C may be from about 0 inch to a distance that would put port stopper 522 in about the center of main lid body 512; this distance may vary with the size and shape of the lid, and will typically be chosen for convenience in manufacturing and/or use of the lid 520. In particular, distance C may be chosen to correspond to a location that facilitates use of colorant dispensers typically used for tinting paints or other coatings. Note that although a circular lid 520 is shown in FIG. 10, the lid may be square, or rectangular, or any other shape as may be convenient. Note also that rim 514 may be of a similar shape as shown at rim 14 in FIG. 2, but may be any convenient form of closure, for example bendable metal flanges or an adhesive. Alternatively, lid 520 may be integral with a can or other container, in which case no rim or equivalent closure means may be needed.

The diameter of port assemblies according to the invention may vary according to the type and size of can on which the lid with port assembly is to be used, the nature of the contents contained in the can, and/or other factors. A lid for use with a paint can may typically have a port assembly affording a port size of between about 1½ inches and about 4 inches, to allow the entry of paintbrushes. Typically, the port diameter will be between about 2 inches and about 3 inches. Such a size will tend to facilitate the addition of paint pigment by automated paint color matching equipment such as is widely used in the art to prepare custom color paints.

Figure 11:
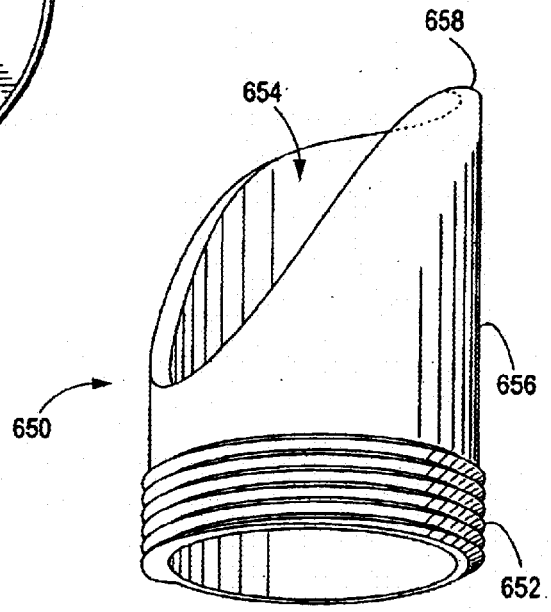
FIG. 11 is a perspective view of a pouring spout designed to fit into a lid equipped with a port collar, according to yet a further aspect of the invention.

FIG. 11 shows, in another embodiment of the invention, a pouring spout 650 adapted to screw into a port collar such as has been described and illustrated in FIGS. 2 and 6. Pouring spout 650 comprises a hollow body with an optionally threaded cylindrical section 652 at one end, and may optionally have an angled opening 654 along part of the wall 656 and across part of the top end 658 of the spout. Use of such a spout may afford a convenient means of discharging the contents of a can that has been equipped with a port collar, without the need to remove the lid. The lid may then be closed with a port stopper such has been described in relation to the drawings. Pouring spout 650 may be made of any convenient material, including as nonlimiting examples a metal, wood, glass, ceramic, or a polymeric material. If a resilient material such as a rubber or other polymeric material is used for its construction, pouring spout 650 may optionally be made without threads, but rather be press-fit into a port collar prior to use.

Figure 12:
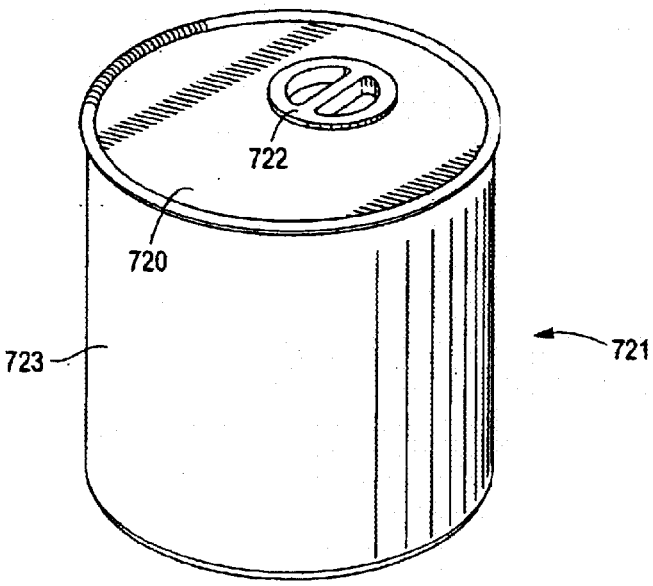
FIG. 12 is a perspective view of a can equipped with a lid comprising a port assembly, according to an even further aspect of the invention.

FIG. 12 is a perspective view of a can 721 comprising a body 723 upon which is mounted a lid 720 fitted with a port stopper 722, according to another aspect of the invention. Such a can may be used to contain a variety of materials, including but not limited to paint, varnish, stain, lacquer, drying oil. It may also be used for storing foodstuffs such as honey, maple syrup, and other edibles. It may also be used for holding motor oil or other lubricants, solvents, or other industrial materials. Other uses are possible, and are contemplated by this invention.

A port assembly according the invention makes it possible to easily open the can, for access to the contents for the purposes of dispensing or for adding colorant or other additives, for example when a custom color is being prepared, or when biocides such as fungicides, algaecides, and/or bactericides are to be added. These are to be construed as non-limiting examples, since the benefits of the present invention are not limited to a particular type of material contained in, or added to, the can. It is also contemplated that the present invention may be used to introduce any or all of any number of ingredients into the can, in any sequence.

Such additions may be done without the customer ever needing to open the can at the rim, as is currently done, thereby risking contamination of the joint where the rim attaches to the can. Thus air leakage may be minimized, potentially improving the shelf life of the contents of the can. Use of the port assembly may also reduce time and effort involved in the process of adding colorant, and the process of neatly dispensing liquids from the can, using the optional spout described above.

Having described the invention, we now claim the following and their equivalents.

What is claimed is:

1. A port assembly for a can with a removable lid, the port assembly adapted to allow inspection of and access to an interior of the can without removal of the lid, the port assembly comprising:

a) a port in the lid; and b) a port stopper adapted to interface with the port to create a closed configuration in which contents of the can cannot escape and an open configuration that provides access to contents of the can, the port stopper having at least one portion thereof that is substantially transparent and substantially colorless to allow visual inspection of the contents of the can in the closed configuration;

wherein the port comprises an opening in the lid and a port collar affixed in the opening for interfacing with the port stopper;

wherein the port stopper comprises a first set of threads and the port collar comprises a second set of threads for interfacing with the first set of threads; and wherein the first set of threads is located on a bottom portion of the port stopper, the bottom portion comprising a hollow cylinder having an open end, and wherein the port collar comprises a threaded well comprising an inner tube having an outer surface, an outer tube having an inner surface, a connecting ring between the inner tube and the outer tube, and an annular region between the inner surface of the outer tube and the outer surface of the inner tube, the second set of threads being located on one of the inner surface of the outer tube or the outer surface of the inner tube.

2. The port assembly of claim 1 wherein the bottom portion of the port stopper has a bottom end located between about ¼ inch and about 1 inch below a lower surface of a main body portion of the lid.

3. The port assembly of claim 1 wherein the port collar is affixed to said lid at a joint.

4. The port assembly of claim 3 wherein said joint comprises a resilient material.

5. The port assembly of claim 4 wherein said resilient material is selected from the group consisting of synthetic and natural latex rubbers, neoprene, acrylonitrile-butadiene-styrene block copolymers, styrene-butadiene-styrene block copolymers, thermoplastic elastomers, ethylene-propylene rubbers, and silicone elastomers.

6. The port assembly of claim 1, wherein the removable lid comprises a paint can lid.

7. The port assembly of claim 6, wherein the paint can lid comprises a lid adapted to fit a quart or one-gallon can.

8. The port assembly of claim 1, wherein the port has a size sufficient to allow introduction of either or both of colorants and biocides into the can.

9. The port assembly of claim 1, the port stopper further comprising a lip around the hollow cylinder at an end opposite the open end.

10. The port assembly of claim 1, wherein the port stopper comprises one or more means for engagement of and transfer of torque to the port stopper for unscrewing the port stopper from the port collar.

11. The port assembly of claim 10, wherein the means for engagement comprises a slot suitable for engagement by a spatulate tool.

12. The port assembly of claim 1, wherein the port stopper comprises a closed top, a depression within the closed top, and a grip at least partially within the depression for manual engagement of and transfer of torque to the port stopper.

13. The port assembly of claim 1, wherein the substantially transparent, substantially colorless portion of said port stopper is substantially coextensive with said port.

14. The port assembly of claim 1, wherein said port stopper comprises a material selected from the group consisting of polymethyl methacrylate, polycarbonate, and polyethylene terephthalate.

15. The port assembly of claim 12, wherein said depression is substantially coextensive with said port, and wherein said grip lies completely within said depression.

16. The port assembly of claim 15, wherein said grip is shaped substantially as a diametric rectangular bar.

* * * * *

UNITED STATES PATENT AND TRADEMARK OFFICE

CERTIFICATE OF CORRECTION

PATENT NO. : 6,761,287 B2
DATED : July 13, 2004
INVENTOR(S) : Nicholas A. Caruso It is certified that error appears in the above-identified patent and that said Letters Patent is hereby corrected as shown below:

Column 4,
Line 11, delete "Although fasteners are shown screws or."
Line 12, delete "rivets."

Add claim 17, -- 17. The port assembly of claim 1 additionally comprising a removable pouring spout adapted to interface with the port. --

Add claim 18. -- 18. The port assembly of claim 1 additionally comprising a removable pouring spout having a third set of threads adapted to interface with the second set of threads. --

Signed and Sealed this

Thirtieth Day of November, 2004

JON W. DUDAS
*Director of the United States Patent and Trademark Office*